US005282291A

United States Patent [19]

Spieler et al.

[11] Patent Number: 5,282,291

[45] Date of Patent: Feb. 1, 1994

[54] FORCE SENSITIVE HANDLE FOR HAND OPERATED IMPLEMENT

[75] Inventors: Eric L. Spieler, Bala Cynwyd; Richard M. Berman, Dresher, both of Pa.

[73] Assignee: Bioware Inc., Bala Cynwyd, Pa.

[21] Appl. No.: 945,862

[22] Filed: Sep. 16, 1992

[51] Int. Cl.[5] ..... A46B 15/00

[52] U.S. Cl. ..... 15/167.1; 15/105; 434/263

[58] Field of Search ..... 15/167.1, 167.2, 176.1, 15/176.6, 105, 22.1, 159 A; 128/774, 776, 777; 434/263

[56] References Cited

U.S. PATENT DOCUMENTS

| | | | |
|---|---|---|---|
| 4,253,212 | 3/1981 | Fujita | 15/167.1 |
| 4,340,069 | 7/1982 | Yeaple | 128/776 |
| 4,476,604 | 10/1984 | White et al. | 15/167.1 |
| 4,680,825 | 7/1987 | White et al. | 15/167.1 |
| 4,744,124 | 5/1988 | Wang et al. | 15/167.1 |
| 4,779,173 | 10/1988 | Carr et al. | 362/109 |
| 4,788,734 | 12/1988 | Bauer | 15/167.1 |
| 4,944,296 | 7/1990 | Suyama | 128/393 |
| 4,969,868 | 11/1990 | Wang | 604/20 |
| 5,133,102 | 7/1992 | Sakuma | 15/167.1 |

OTHER PUBLICATIONS

Bass, Charles C., "The Optimum Characteristics of Toothbrushes for Personal Oral Hygiene;" Dental Items of Interest; Jul. 1948; pp. 697–718.

Hamington, John H., "Automatic and Hand Toothbrushing Abrasion Studies", The Journal of the American Dental Association, vol. 68, Mar. 1964; pp. 29–36.

Allen, R. W. B., "A Transducer for Measuring the Force Exerted on Teeth by a Toothbrush during Brushing", British Division; J. Dent Res. Supplement to No. 5, p. 1272

Breitenmoser, Jürg, "Damaging Effects of Toothbrush Bristle End Form on Gingiva", J. Peridontol, Apr. 1979, pp. 212–216.

*Primary Examiner*—Harvey C. Hornsby
*Assistant Examiner*—Patrick F. Brinson
*Attorney, Agent, or Firm*—Volpe and Koenig

[57] ABSTRACT

An improved handle for a hand operated implement of the type for which it is desirable to control the force of application. The handle has bifurcated sections which are connected by a means for sensing the applied force and indicating a variation of the applied force from a desired level.

12 Claims, 9 Drawing Sheets

FORCE SENSITIVE HANDLE FOR HAND OPERATED IMPLEMENT

BACKGROUND OF THE INVENTION

1. Field of the Invention

This invention relates to a force sensitive handle for a hand operated implement. More particularly, it relates to a force sensitive handle which produces a warning signal upon detection of a force above a desired level. Most particularly, the present invention finds use in a toothbrush handle to sense the applied brushing force and produce a warning indication at a predetermined force level.

2. Description of the Prior Art

Effective toothbrushing requires a user to impart a controlled amount of force in applying the toothbrush to the teeth. If too little force is applied, ineffective cleaning results. If excessive force is used, injury to the surface of the gums surrounding the teeth, as well as excessive erosion of the enamel, dentin and root on the teeth, can result. It has been found that a brushing force, applied normal to the teeth, of 200 to 300 grams is required for effective brushing.

Various devices have been designed to teach the proper brushing force to be imparted during toothbrushing in order to obtain effective cleaning without damage. U.S. Pat. No. 4,253,212 discloses a pressure detection device which may be provided inside or outside of the stem of the toothbrush.

U.S. Pat. Nos. 4,476,604 and 4,680,825 disclose toothbrush holders which sense the amount of force being applied to the toothbrush. Each holder clamps onto and about the toothbrush handle and emits an audio or visual signal when a certain force is applied. The holder is adjustable to permit the users to change their brushing habits by incrementally increasing the applied force until the desired level is reached.

The devices disclosed in these prior patents have several drawbacks. The devices disclosed in the '212 patent require a separate training appliance which is attached to a toothbrush handle. This separate add-on training appliance extends the handle to a longer than standard length. This affects the balance of the toothbrush and the user's grip, which can cause variations in brushing force once the training device is removed. Thus, it produces an unnatural instrument.

The pressure sensing toothbrush holders disclosed in the '604 and '825 patents are also add-on devices which attach to the toothbrush handles. Additionally, the holders are bulky in comparison to the toothbrush handle itself and require the user to adjust their grip to accommodate the larger holder size. Once again, they produce an unnatural instrument.

SUMMARY OF THE INVENTION

The present invention discloses an improved handle for a hand held implement of the type for which it is desirable to control the force applied. The improvement comprises a bifurcated handle in which the bifurcated portions are connected by means for sensing the applied force. Upon detecting a variation of force from a desired level, a warning is issued.

It is an object of this invention to provide a means for sensing the force applied to a hand operated implement and activating a warning device upon the detection of a variation of the force from a desired level.

It is an object of this invention to provide a means for sensing the force with which a toothbrush is being applied and producing a warning indication upon detection of a variation of the force from a desired level.

It is an object of this invention to provide a toothbrush having a handle which contains a means for sensing the force with which the toothbrush is being applied and producing a warning indication upon detection of a variation of force from a desired level.

DESCRIPTION OF THE PREFERRED EMBODIMENTS

Figure 1:
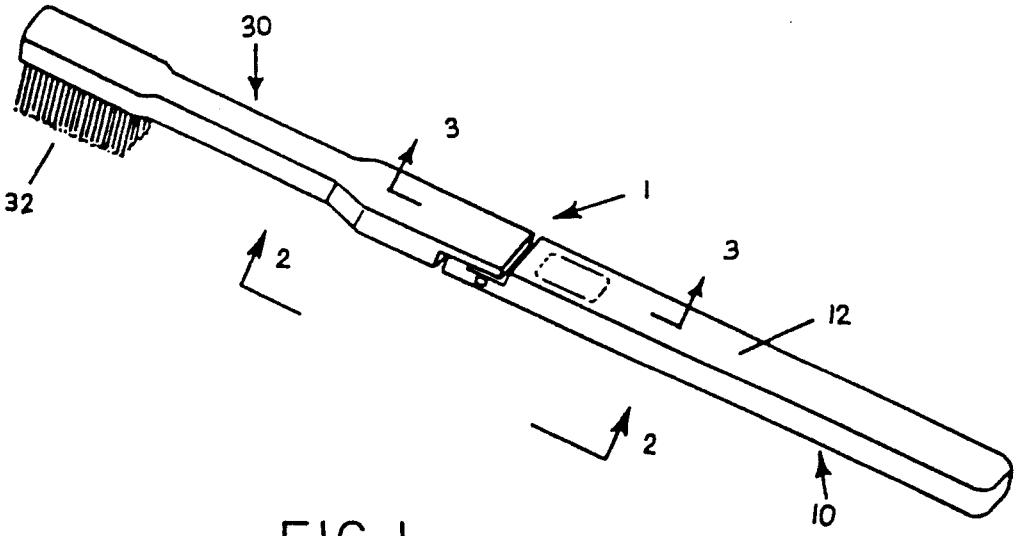
FIG. 1 is a perspective view Of a first embodiment of the present invention having a visual warning device.

Referring to FIG. 1, there is shown a toothbrush having a handle 1 according to the present invention. The bifurcated handle 1 is comprised of a distal or gripping portion 10 which is pivotally connected to a proximal or brush portion 30. The gripping portion 10 has an external surface 12, and the brush portion 30 has an arrangement of multiple bristles 32 in a prearranged pattern. Both the gripping portion 10 and brush portion 30 in this embodiment are made of a moldable plastic material.

Figure 3:
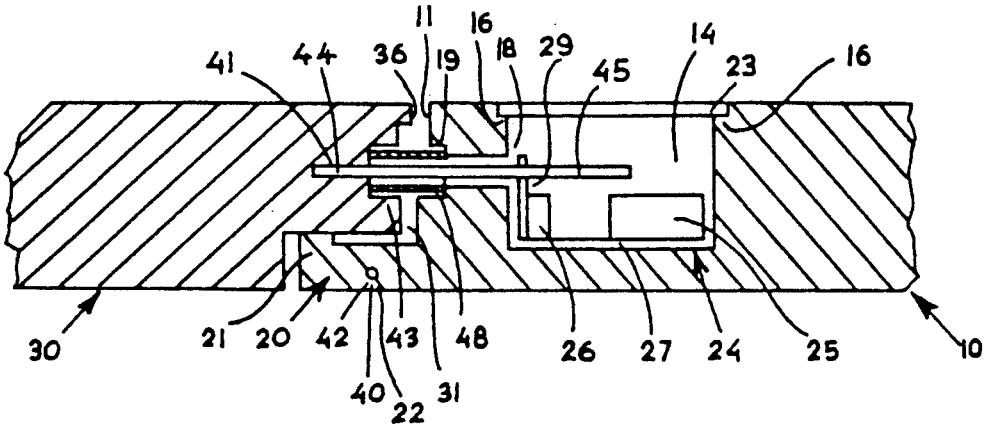
FIG. 3 is a partial section along line 3—3 in FIG. 1.
Figure 4:
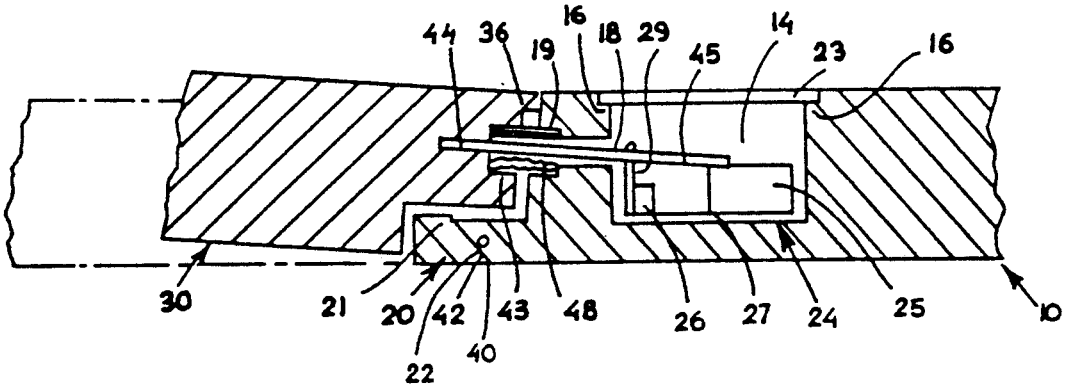
FIG. 4 is a section similar to FIG. 3 which illustrates an application of force to the embodiment of FIG. 1
Figure 2:
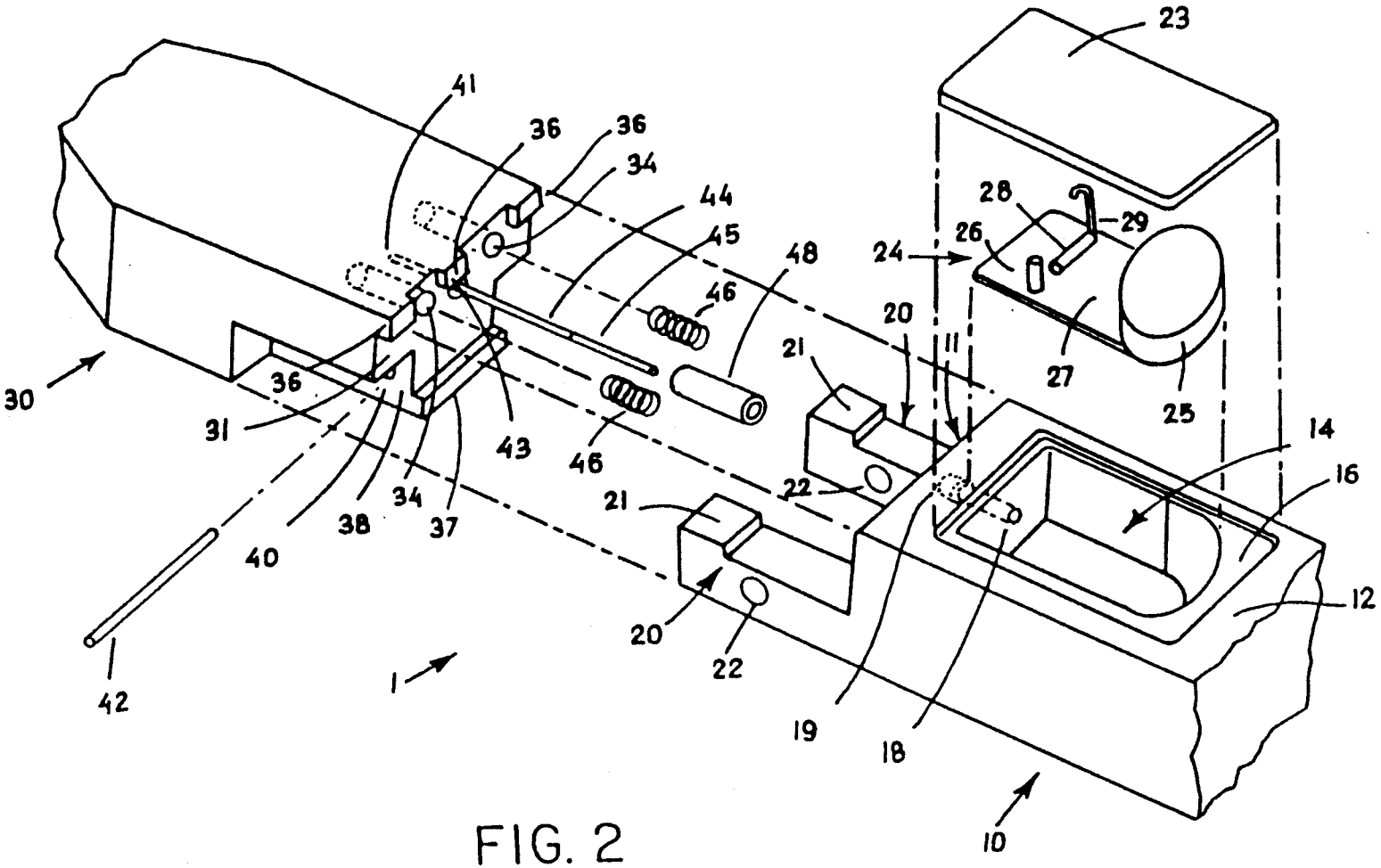
FIG. 2 is an exploded perspective view of the first embodiment of the invention along line 2—2 of FIG. 1.

Referring to FIGS. 2, 3 and 4, the juncture between the distal portion 10 and the proximal portion 30 of the toothbrush handle 1 is shown in more detail. The portion 10 includes a juncture end 11 and a cavity 14. A pair of hinge knuckles 20 with aligned apertures 22 extend from the juncture end 11. The hinge knuckles 20 include rotational travel limiting stops 21.

Located adjacent to the juncture end 11 of the gripping portion 10 is the cavity 14. The cavity 14 is designed to house a warning device 24. The recessed shoulder 16 is set below the gripping surface 12 of the gripping portion 10 and rings the cavity 14. Cover 23 rests on the shoulder 16 and seals off the cavity 14, after warning device 24 is installed. The cover 23 is designed to fit flush with gripping surface 12 and is generally made of the same material as the gripping and brush portions 10 and 30 of handle 1. At least a part of the cover 23 or part of the distal portion 10 surrounding the cavity 14 is made of a transparent or translucent material.

As illustrated most clearly in FIGS. 3 and 4, aperture 18, approximately 0.050" in diameter, extends from the juncture end 11 of gripping portion 10 to the cavity 14. The diameter of the aperture 18 is enlarged at the juncture end 11 to approximately 0.070" to form a cylindrical cavity 19. The cavity 19 is used to support the seal 48.

Referring now to FIG. 2, the proximal portion 30 includes a juncture end 31 and a brush end with an arrangement of multiple bristles 32. A plurality of cylindrical cavities 34, normal to the juncture end 31, extend into the brush portion 30. A pair of concentric cylindrical cavities 41 and 43 are generally located on centerline with and opposite to aperture 18 and cavity 19 in the distal portion 10. The seal retaining cavity 43 is approximately the same diameter and depth as the seal retaining cavity 19 in the distal portion 10. The contact arm support cavity 41 extends from the base of the cavity 43 into the proximal portion 30 and is sized to provide a snug fit with the contact arm 44. The hinge knuckle 38, with an aperture 40, is located on the proximal portion 30 to fit between hinge knuckles 20 on the distal portion 10. A rotational travel limiting stop 37 protrudes from the lower edge of hinge knuckle 38. Aperture 40 is located for alignment with apertures 22. Rotational travel limiting stops 36 project from juncture end 31 and above the hinge knuckle 38.

Cantilevered from juncture end 31 of the distal portion 30 is a contact arm 44. The contact arm 44 is closely fitted into cavity 41 and generally on centerline with aperture 18. The diameter of the contact arm 44 is sufficiently smaller than the diameter of the aperture 18 in the distal portion 10 to allow for the required movement of the contact arm 44 without contacting the walls of the aperture. Stated in another way, the contact arm 44 is cantilevered from the cavity 19 through the aperture 18. As illustrated in FIG. 3, the contact arm 44 extends to a position over the battery 25. At least portion 45 of the arm 44 is conductive. The conductive portion 45 of contact ar 44 acts as the switching element for the warning device 24. In the preferred embodiment, the entire contact arm 44 is made of gold plated brass.

The warning device 24 is comprised of a circuit board 27 upon which a battery 25, a resistor 28 and a light emitting diode (L.E.D.) 26 are mounted. The board 27 is sized to fit within cavity 14. The resistor 28 can be cylindrical, as illustrated, or a wafer type resistor can be mounted on the surface of battery 25. A flexible lead 29 extends from the resistor 28 and is attached to the conductive portion 45 of the contact arm 44.

Figure 5:
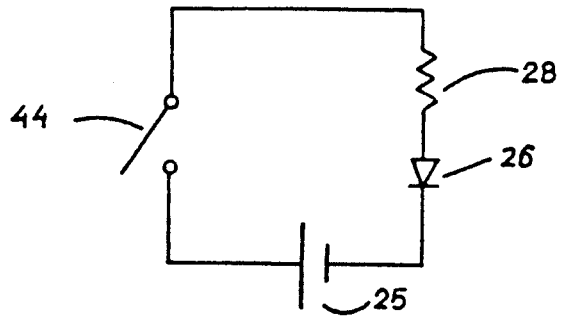
FIG. 5 is an electrical circuit diagram for the visual warning indicator of the first embodiment.

A circuit diagram for a completed circuit is shown in FIG. 5. The battery 25 is a 3.0 volt battery. A suitable part is member CR1025 manufactured by Hitachi Maxell, Ltd. A commercially available 1150 ohm resistor 28 and an LED 26, such as part number HLMP-Q155 manufactured by Hewlett-Packard Co., are wired in series with the battery 25. The conductive portion 45 of contact arm 44 acts as the switching element. It will be recognized by those skilled in the art that other similar circuits utilizing different components can be used in like fashion.

Referring again to FIGS. 2, 3 and 4, the gripping portion 10 and brush portion 30 of the handle 1 are connected by hinge pin 42. Springs 46 are disposed in the corresponding cavities 34. Springs 46 bear on juncture end 11 of gripping portion 10 and urge the brush portion 30 of handle 1 into contact with the rotational travel limiting stops 21; juncture end 11 also contacts rotational travel limiting stop 37. Springs 46 maintain the gripping and brush portions of the handle 1 in the rest position shown in FIG. 3. The springs 46 are selected to produce a certain preload force before allowing relative movement between the gripping portion 10 and brush portion 30 of the handle from the rest position, illustrated in FIG. 3, to the active position, illustrated in FIG. 4. At present, the preferred preload force is approximately 300 grams.

Referring again to FIG. 2, a compressible tubular plastic seal 48 is placed around the contact arm 44 and seated in cavity 19 in the gripping portion juncture end 11 and cavity 43 in brush portion juncture end 31 of the handle 1. As illustrated in FIG. 3, the length of the tubular seal 48 is greater than the combined depths of cavities 19 and 43 and the intervening gap between the juncture ends 11 and 31. During the final assembly of the gripping and brush portions 10 and 30 of the handle 1, the seal 48 is compressed to insure that it is firmly seated in the cavities 19 and 43. This prevents moisture from entering the cavity 14 to prevent corrosion of the electrical components. Preferably, the seal 48 is made from polyvinyl chloride or silicone rubber.

Having described the structure of the handle 1, its operation Will be explained with reference to FIGS. 3 and 4. When a force in excess of about 300 grams is applied through gripping portion 10 of handle 1 and transferred to the bristle portion 32 of the brush portion 30, the springs 46 compress and the portions 10 and 30 pivot about hinge pin 42. This causes the conductive portion 45 of the contact arm 44 to come into contact with battery 25, thereby completing the circuit, illustrated in FIG. 5, and lighting L.E.D. 26. The motion of the tip of the conductive portion 45 of the contact arm 44 is arcuate. But upon contacting the surface of the battery 25, the contact arm 44 flexes slightly, causing the tip of the conductive portion 45 to scrape along the surface, penetrating any surface oxidation which may interfere with the conductive contact with the battery 25.

The lighted L.E.D. 26 provides a visual signal which can be seen through the transparent or translucent part of the gripping portion 10 and/or cover 23 of the handle 1 and can be observed by the user in a mirror. In the preferred embodiment, a lighted L.E.D. indicates that too much brushing force is being applied.

If additional force is applied beyond the amount required to bring arm 44 into contact with battery 25, the stops 36 on the juncture end 31 of brush portion 30 come into contact with juncture end 11 of the gripping portion 10. This prevents damage to the contact arm 44.

If desired, an audio signal generator can be substituted for or provided in addition to the L.E.D. to provide an audible warning or both an audible and visual warning when excessive brushing force is applied.

Figure 6:
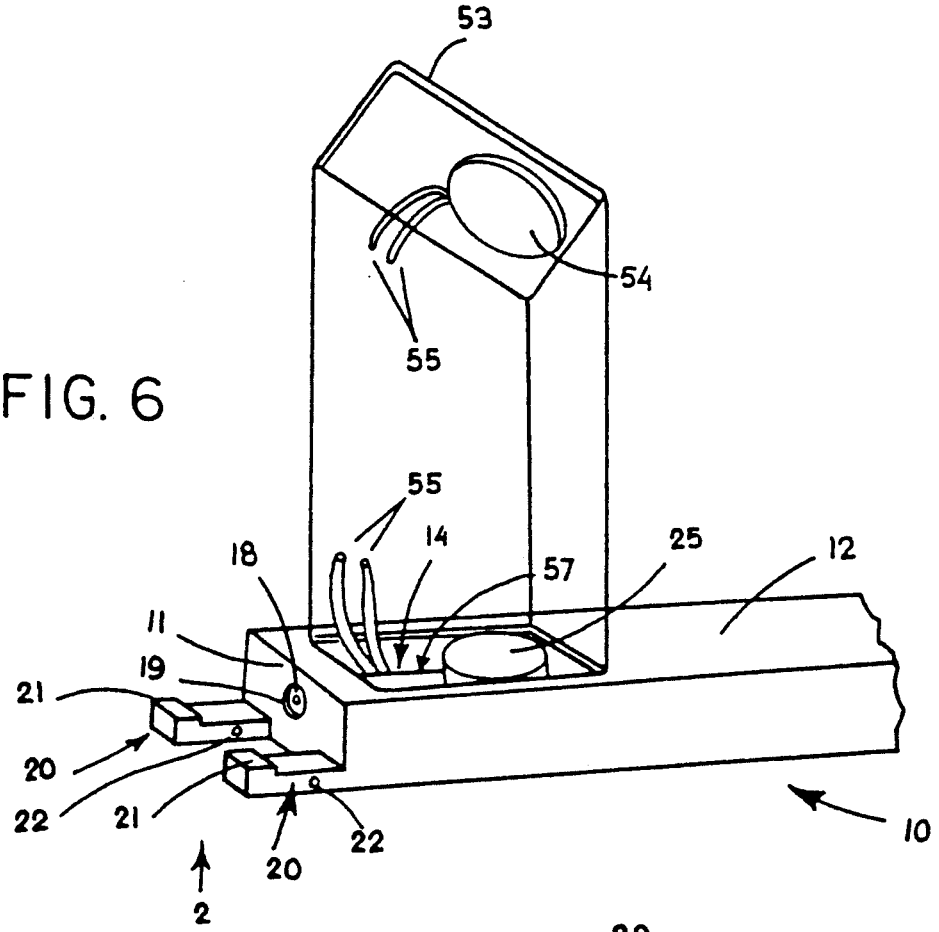
FIG. 6 is a perspective view showing the distal portion of the handle for a second embodiment of the invention having an audio warning device.

A view of the proximal portion 10 of a second embodiment of the handle 2 according to the present invention is shown in FIG. 6. This second embodiment utilizes an audible warning device 57. The bifurcated handle 2 has the same construction as handle 1 of the first embodiment. Like numerals indicate like elements which were previously described.

Referring to FIG. 6, the cover 53 has a piezoelectric ceramic element 54 attached to it. The piezoelectric element 54 is a sintered body of many crystals. When excited electrically, the crystals resonate. The cover 53 is made, at least partially, of a metallic material which resonates to produce an audible tone when the attached piezoelectric element 54 is excited. These piezoelectric elements are the type commonly used in electronic alarm watches. Leads 55 extend from the piezoelectric element 54 and connect it to the warning device 57.

Figure 7:
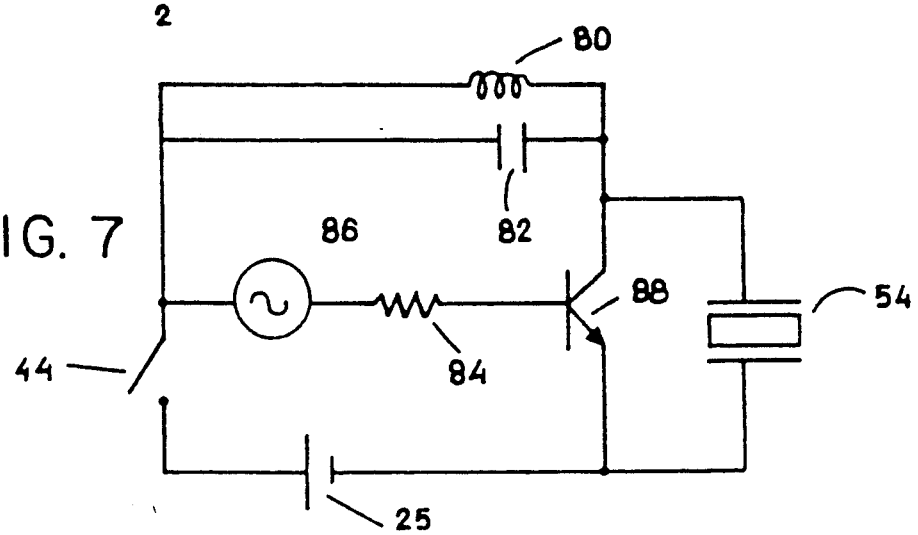
FIG. 7 is a circuit diagram for the second embodiment.

The cover 53 and audible warning device 57 utilize the circuit illustrated in FIG. 7 to produce an audible warning. The circuit is powered by the battery 25. A switching element, consisting of contact arm 44, is attached to the positive terminal of the battery 25. The opposite pole of the switch 44 is connected to a first branch of the circuit consisting of an oscillator 86 and a resistor 84 which are connected to the base of a transistor 88. The second branch of the circuit is an L-C filter consisting of a capacitor 82 and an inductor 80 connected between the switch 44 and the collector of the transistor 88. The piezoelectric element 54, attached to cover 53, is connected between the collector and emitter of transistor 88, and the emitter is connected to the negative terminal of the battery 25. When the switching element 44 is closed, the oscillator 86 provides oscillating current to the base of transistor 88, causing the transistor to repeatedly turn off and on. This causes the current flowing through L-C filter of the second branch of the circuit to flow alternately through the piezoelectric element 54 and the transistor 88. The alternating flow of current through the piezoelectric element 54 excites it, causing both it and the attached cover 53 to resonate and produce a sound.

Figure 8:
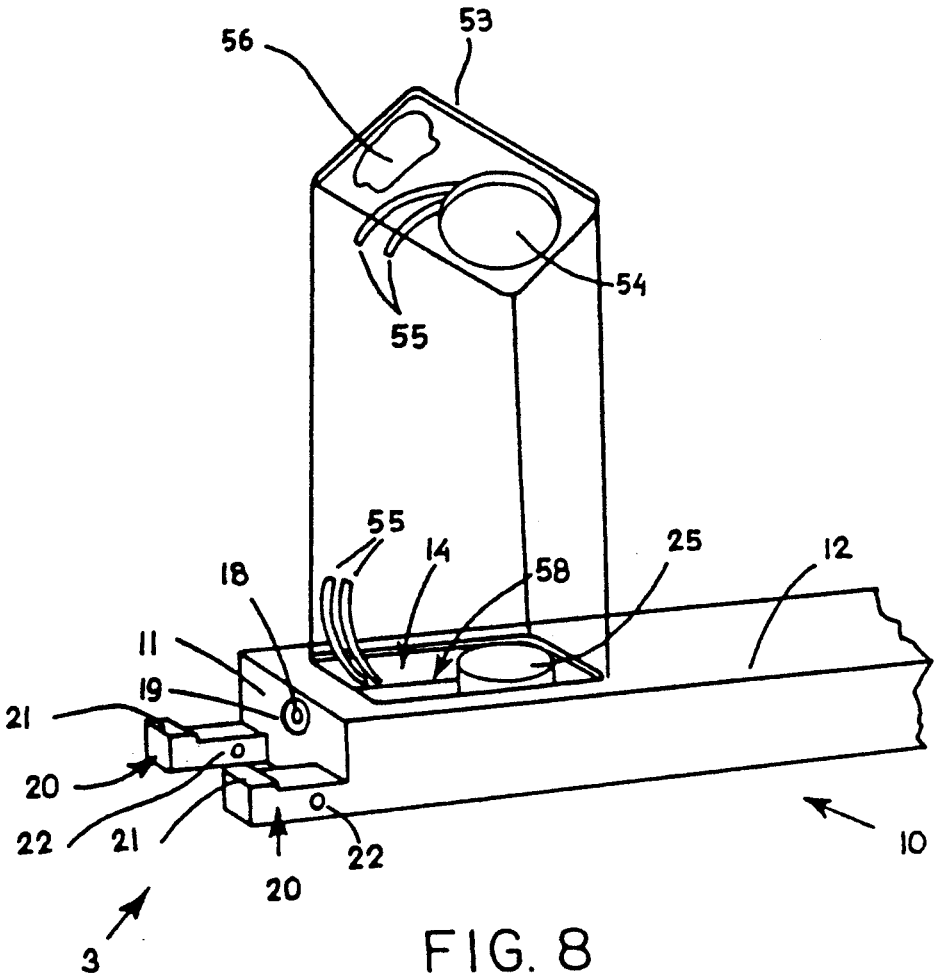
FIG. 8 is a perspective view showing the distal portion of the handle for a third embodiment of the invention having both audio and visual warning devices.

A view of the proximal portion 10 of a third embodiment of the handle 3 according to the present invention is shown in FIG. 8. This third embodiment utilizes both a visual and an audible warning device 58. The bifurcated handle 3 has the same construction as handle 2 of the second embodiment. A portion of the cover 56 or a part of the distal portion 10 surrounding the cavity 14 is transparent or translucent. Leads 55 extend from the piezoelectric element 54 and connect it to the warning device 58.

Figure 9:
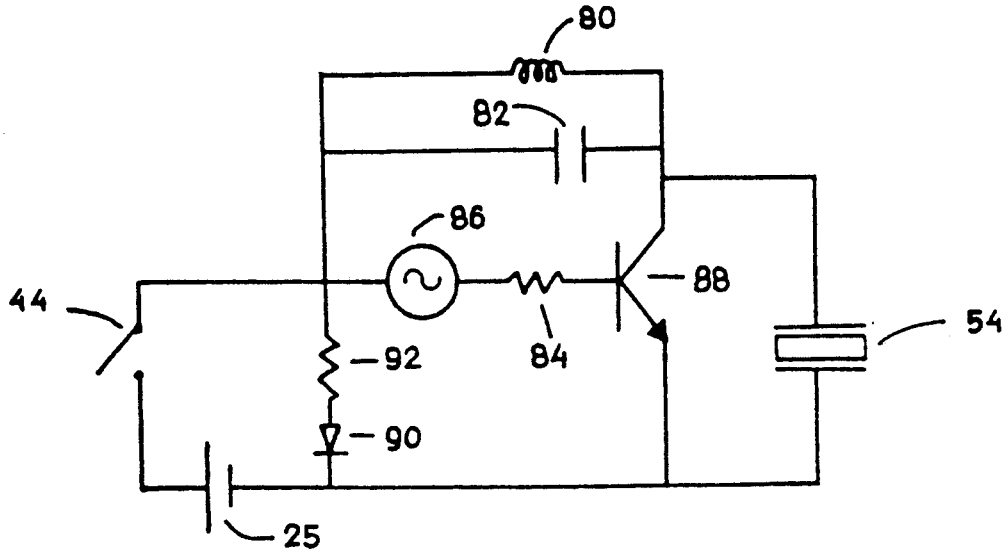
FIG. 9 is a circuit diagram for the third embodiment.

The cover 53 and visual and audible warning device 58 utilize the circuit illustrated in FIG. 9 to produce both a visual signal, in the form of a lighted L.E.D., and an audible signal. The circuit is similar to the circuit shown in FIG. 7. An LED 90 and resistor 92 have been connected between negative terminal of the battery 25 and the switch 44.

As will be appreciated by those skilled in the art, various components can be used for the transistor, resistor, diode, capacitor, inductor and battery in the previously described circuits to produce the desired visual and/or audible warning indication without departing from the scope of the present invention. Multiple L.E.D.'s mounted at differing orientations can also be used. Additionally, the contact arm 44 can be used to actuate a separate membrane switch as a replacement for the conductive portion 45 as the actual switching element. At present, the more positive contact of the preferred embodiment is believed to be more durable and more accurate.

Figure 10:
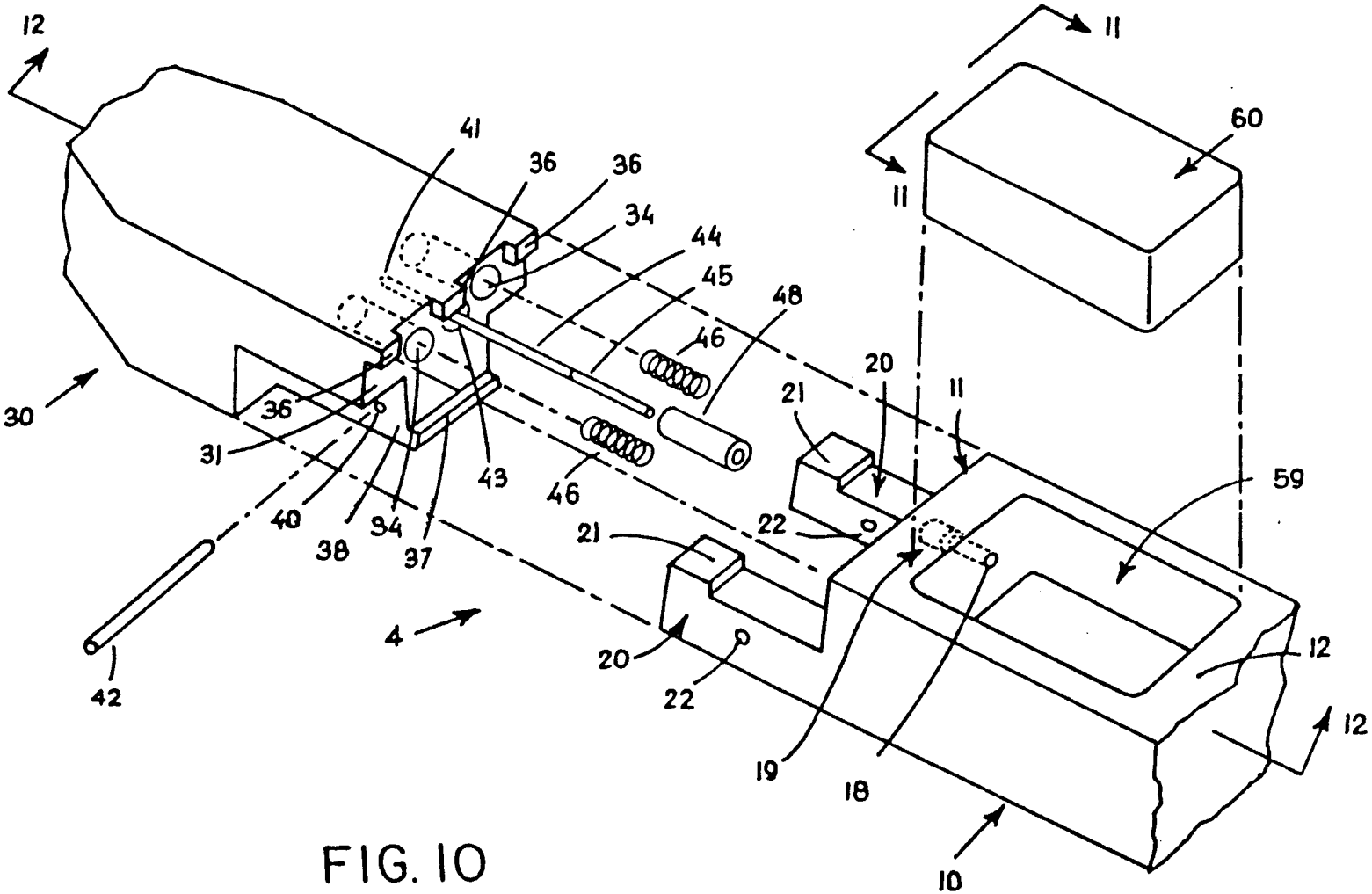
FIG. 10 is an exploded perspective view of a fourth embodiment of the invention.
Figure 11:
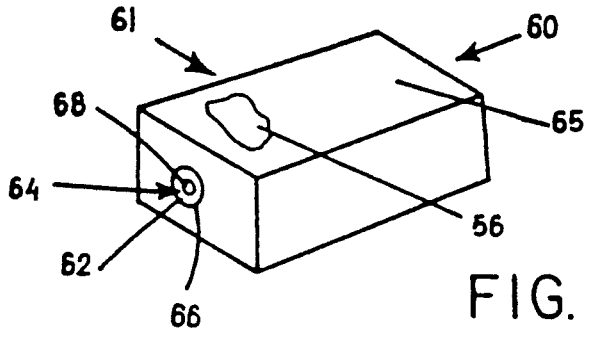
FIG. 11 is a view along line 11—11 in FIG. 10.
Figure 12:
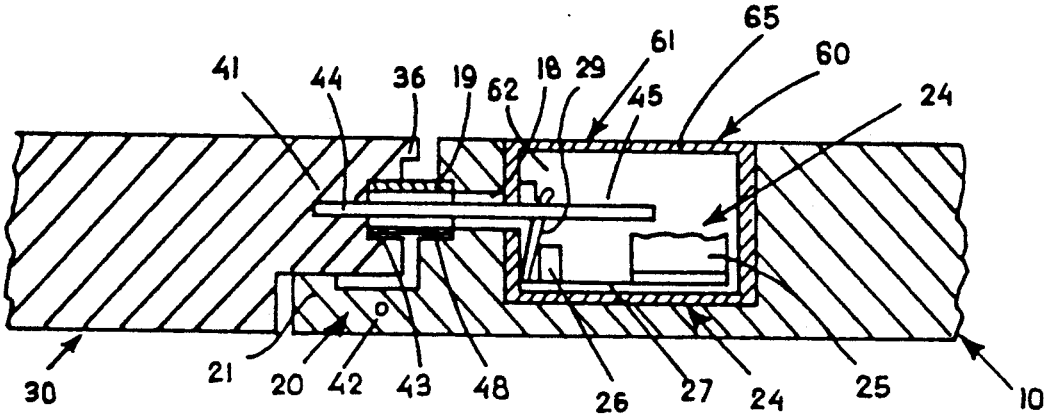
FIG. 12 is an assembled section generally along line 12—12 in FIG. 10.

Referring to FIGS. 10 through 12, a fourth embodiment of a handle 4 according to the present invention is illustrated. The bifurcated handle 4 is similar in construction to handle 1 of the first embodiment. The juncture ends 11 and 31 of the distal and proximal portions 10 and 30 of the handle are identical to the first embodiment. A cavity 59 is located adjacent to the juncture end 11 of the distal portion 10. The cavity 59 is selectively configured to house a sealed, one-piece warning device assembly 60.

The sealed one-piece warning device assembly 60 is shown in more detail in FIGS. 11 and 12. The assembly 60 is comprised of a housing 61 having an upper surface 65. The housing 61 is configured such that the upper surface 65 fits flush with the surface 12 when the warning device assembly 60 is installed. At least a portion of the upper surface 65 is transparent or translucent. An aperture in the housing 62 is located opposite to aperture 18 in distal portion 10 of the handle 4. A flexible boot 64 is attached around the periphery of the aperture 62 and extends into the housing 61.

Figure 13:
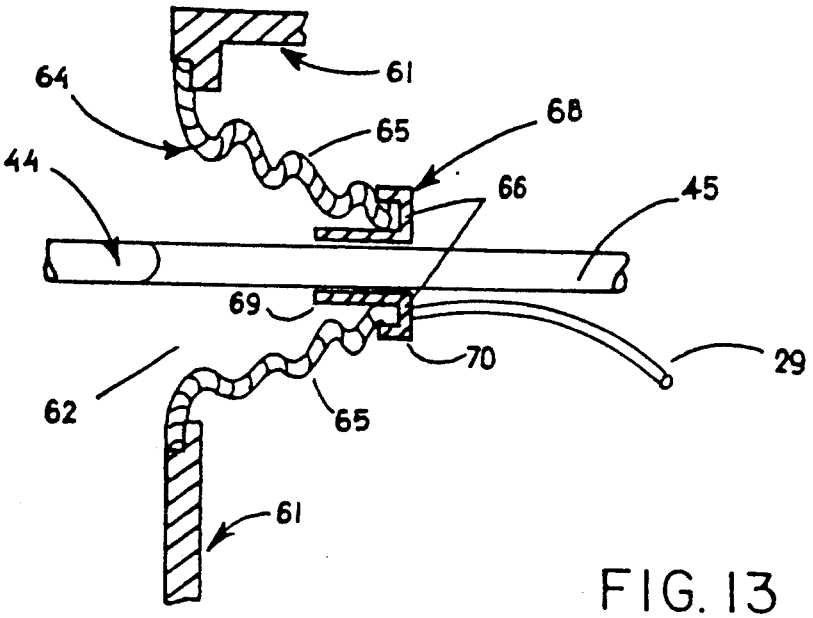
FIG. 13 is an enlarged view of a portion of FIG. 12.

FIG. 13 shows the boot 64 in more detail. The boot tapers down from the larger diameter of aperture 62, which is of sufficient size to allow the required movement of the contact arm 44, to a smaller diameter. Preferably, the boot 64 is formed with bellows 65 which allow the boot to be flexed by the movement of the contact arm 44 without straining either part. At the smaller diameter end, the boot includes a raised lip 66. A conductive sleeve 68 is attached to the lip 66. The sleeve 68 includes a body 69 and a selectively configured boot attachment portion 70. The sleeve body 69 extends back into the boot 64. The diameter of the sleeve body 69 is equal to or slightly greater than the diameter of the conductive portion 45 of contact arm 44. Referring to FIG. 12, located inside the housing 61 is one of the warning devices as previously described. Flexible lead 29 is attached to the sleeve 68 at the time of the assembly of sealed unit 60.

As illustrated in FIG. 12, when the distal and proximal portions 10 and 30 of the handle 4 are assembled, the contact arm 44 is inserted through the sleeve 68. A conductive adhesive is used to connect and seal the sleeve body 69 to the conductive portion 45 of the contact arm. Conductive contact is required in order for the contact arm 44 to act as the switching element for the warning device 24 as previously described.

Figure 14:
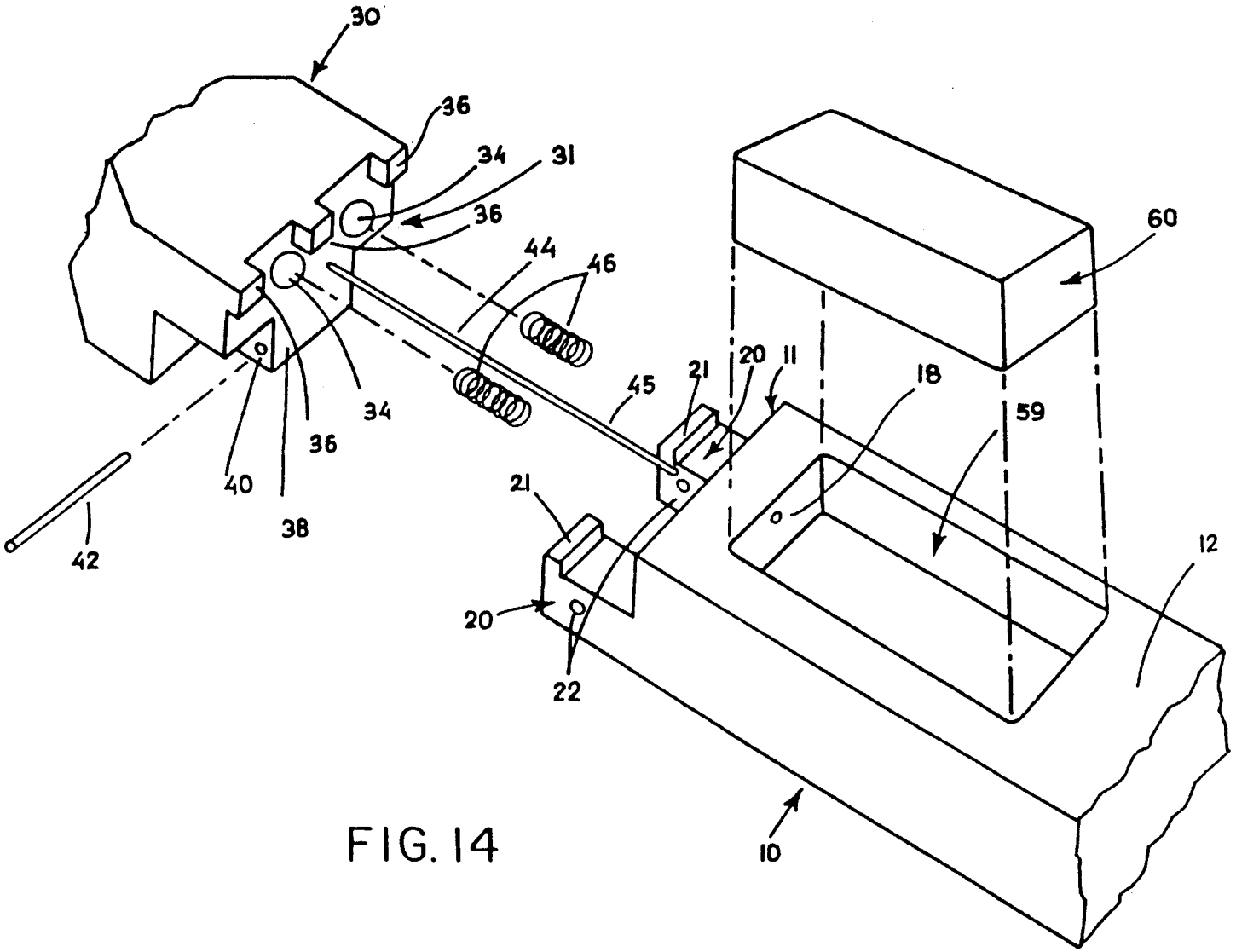
FIG. 14 is an exploded perspective view of the fourth embodiment of the invention without a seal.

By utilizing the sealed warning device assembly 60, the possibility of malfunction due to the ingress of moisture into the warning device 24 is further reduced. As shown in FIG. 14, this embodiment can be produced without the tubular seal 48 and the associated seal retaining cavities 19 and 43 to reduce manufacturing costs.

Figure 15:
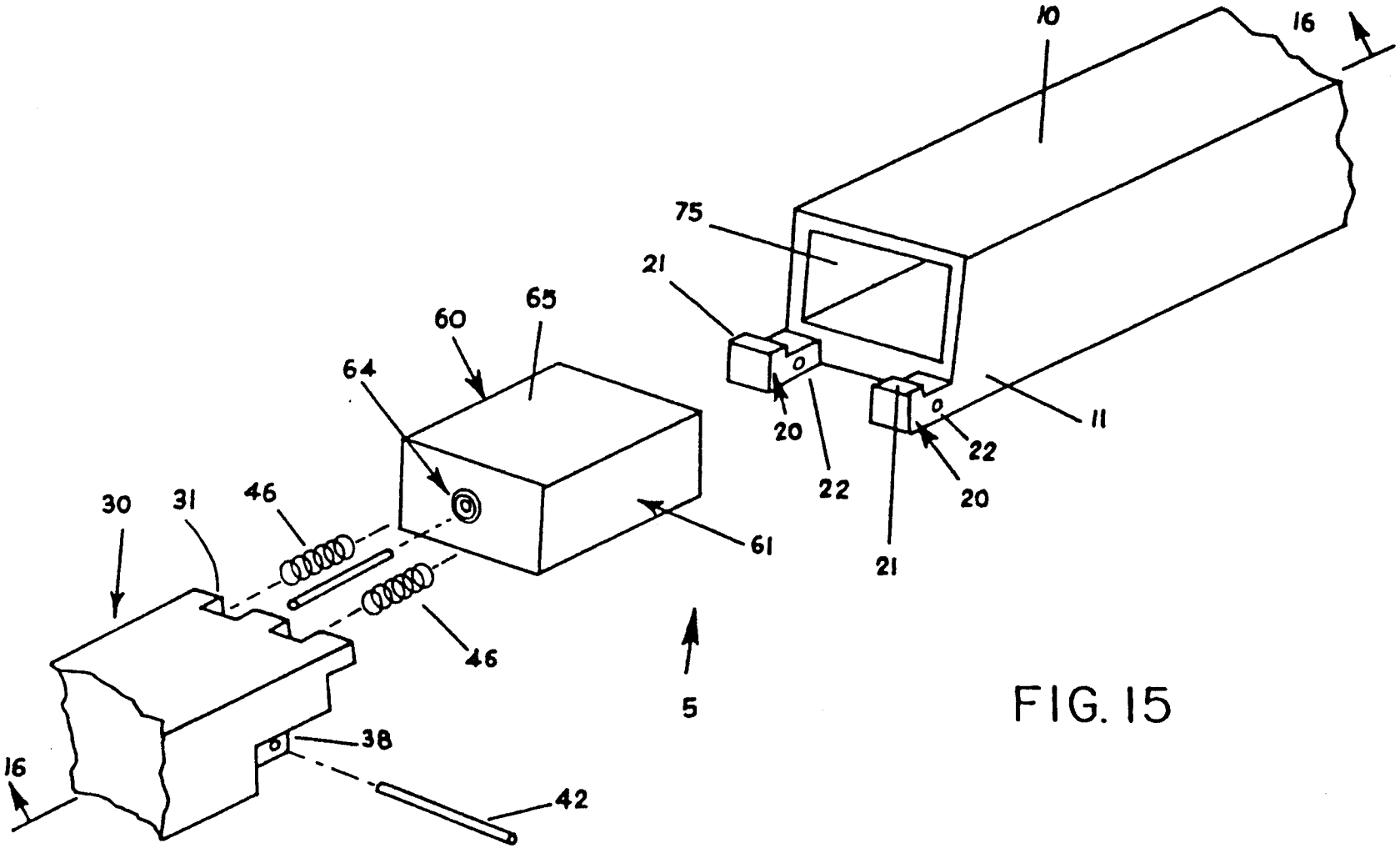
FIG. 15 is an exploded perspective view of a fifth embodiment of the invention.
Figure 16:
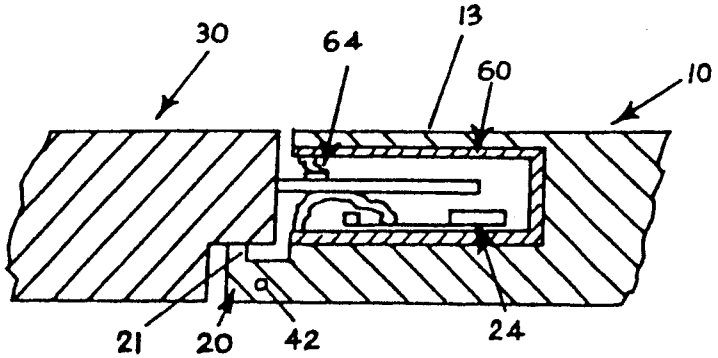
FIG. 16 is an assembled section generally along line 16—16 in FIG. 15.

Referring to FIGS. 15 and 16, a fifth embodiment of the handle 5 according to the present invention is illustrated. The bifurcated handle 5 is similar in construction to handle 4 of the fourth embodiment. A cavity 75 is located in the juncture end 11 of the distal portion 10 to house the warning device 60. At least portion 13 of the distal portion 10 is also transparent or translucent. At assembly, the warning device 60 is secured in the cavity 75. The sleeve body 69 is then crimped to the conductive portion 45 of contact arm 44. This provides positive electrical contact as well as positive sealing of the warning device assembly 60. The distal and proximal portions 10 and 30 are then connected as previously described.

Figure 17:
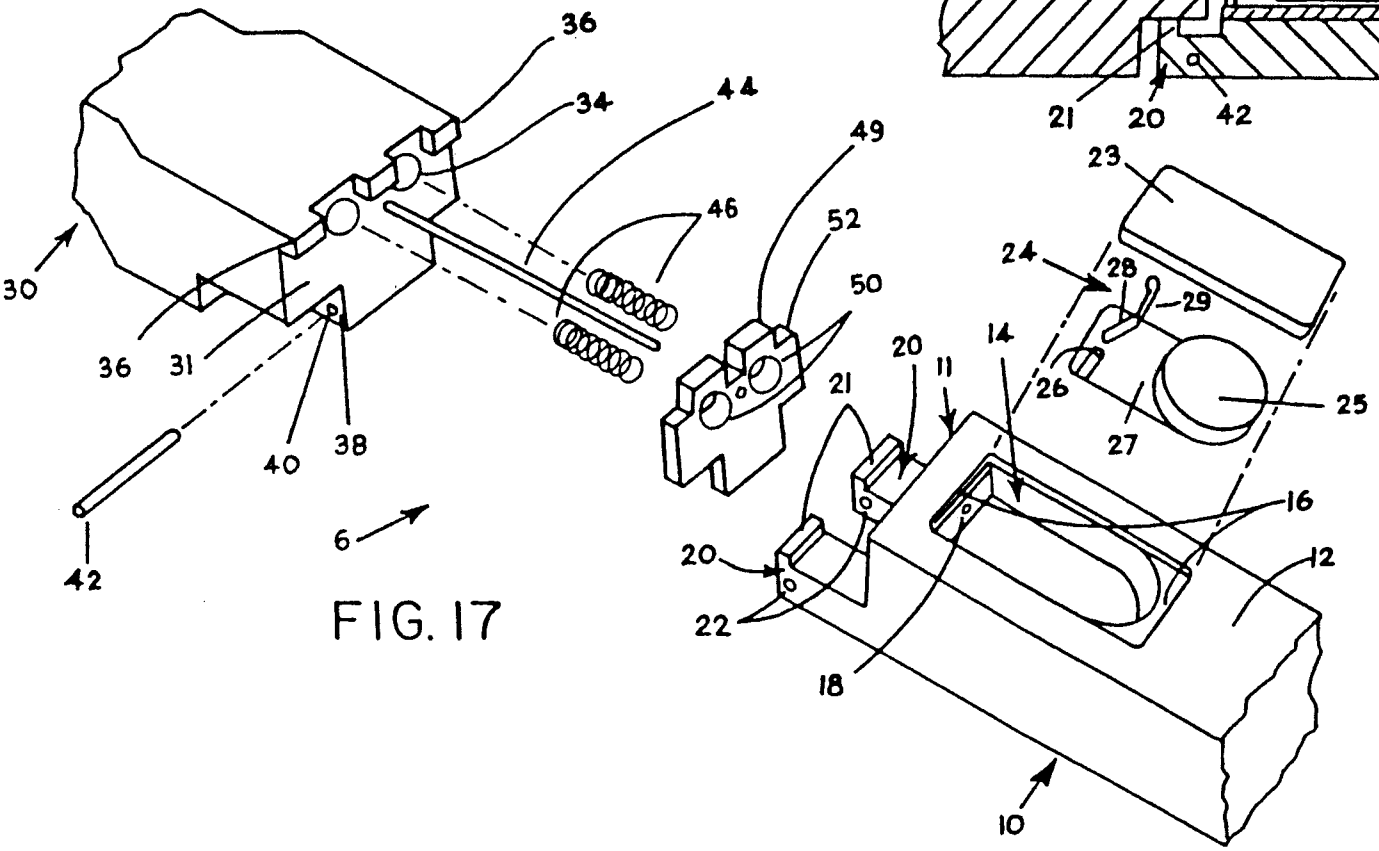
FIG. 17 is an exploded perspective view of a sixth embodiment of the invention.

A sixth embodiment of the handle 6 according to the invention is shown in FIG. 17. The bifurcated handle 6 is similar in construction to the first embodiment 1. Cavities 19 and 43 have been omitted from the distal and proximal portions 10 and 30 of the handle 1. Tubular seal 48 is replaced with a gasket 49 which is located between the ends 11 and 31 of the handle 6. Gasket 49 prevents moisture from entering the cavities 14 or 34 and interfering with electrical operation and contact. The gasket 49 includes apertures 50 and 52 in complementary positions to the springs 46 and the contact arm 44 respectively. Preferably, gasket 49 is made of a non-absorbent silicone sponge rubber which requires between two and seven pounds per squared inch (2 to 7 PSI) of force for 50% compression. The material density can be about 0.012 pounds per cubic inch (lb./in$^3$). An alternate material is a polyolefin close cell foam which requires between 1 to 2 PSI of compressive force for 25% compression.

A single battery 25 should provide approximately 100,000 L.E.D. indications. If an audible warning system is used, the battery life is reduced. Given the life of the battery 25 versus the life of the bristles 32, spare proximal portions with new toothbrush bristles 32 can be sold for use with an existing distal portion 10 of a toothbrush handle according to the present invention. Toothbrush kits consisting of one distal portion 10 of the handle and multiple proximal portions 30 could also permit multiple users.

It will be recognized by those skilled in the art that the disclosed bifurcated force sensing handles, can be easily adapted to a variety of hand held implements of the type for which it is desirable to control the force of application. It will also be appreciated that the force sensing handles can have a variety of forms without departing from the scope of the present invention.

We claim:

1. An improved toothbrush handle comprising:

a bifurcated handle having both gripping and brush portions which are pivotally connected;

one portion having a juncture end with selectively configured hinge knuckles, a cavity and an aperture which connects the cavity to the juncture end;

a warning device disposed in the cavity;

the other portion having a juncture end with a complementary hinge knuckle located in a position to interconnect with the hinge knuckles protruding from the one portion of the handle;

a resilient means for urging the gripping and brush portions toward a rest position until a variation of force from a desired level is applied; and a contact arm protruding through the aperture in the one portion toward the juncture end of the other portion such that the contact arm activates the warning device when said variation of force from said desired level is applied.

2. The device of claim 1 further comprising a plurality of travel limiting stops protruding from the brush portion juncture end.

3. The device of claim 1 wherein the resilient means is comprised of a plurality of cylindrical cavities extending into the brush portion normal to the brush portion juncture end; and a plurality of springs disposed in the cylindrical cavities which bear on the gripping portion juncture end.

4. The device of claim 1 wherein a selectively configured, tubular seal is disposed between the gripping and brush portion juncture ends.

5. The device of claim 1 wherein a selectively configured gasket is disposed between the gripping and brush portion juncture ends.

6. The device of claim 1 wherein the stops contact the gripping portion juncture end when a variation of force above a desired level is applied.

7. The device of claim 1 wherein the warning device is comprised of a battery, a switching element, a resistor and a light emitting diode connected in series.

8. The device of claim 7 wherein at least a portion of the contact arm is conductive, and the conductive portion acts as the switching element.

9. The device of claim 7 wherein the switching element is a membrane switch which is actuated by the contact arm.

10. The device of claim 1 wherein the warning device is an audio signal generator.

11. The device of claim 10 wherein the audio signal is generated by a piezoelectric ceramic element attached to a metal plate.

12. The device of claim 1 wherein the warning device generates both a visual and audio signal.

* * * * *